US008948410B2

(12) United States Patent
Van Leest

(10) Patent No.: US 8,948,410 B2
(45) Date of Patent: Feb. 3, 2015

(54) ACTIVE AUDIO NOISE CANCELLING

(75) Inventor: Adriaan Johan Van Leest, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 341 days.

(21) Appl. No.: 13/139,797

(22) PCT Filed: Dec. 11, 2009

(86) PCT No.: PCT/IB2009/055686
§ 371 (c)(1),
(2), (4) Date: Jun. 15, 2011

(87) PCT Pub. No.: WO2010/070561
PCT Pub. Date: Jun. 24, 2010

(65) Prior Publication Data

US 2011/0249826 A1 Oct. 13, 2011

(30) Foreign Application Priority Data

Dec. 18, 2008 (EP) ..... 08172126

(51) Int. Cl.
*G10K 11/16* (2006.01)
*G10K 11/178* (2006.01)

(52) U.S. Cl.
CPC ..... *G10K 11/178* (2013.01); *G10K 2210/3026* (2013.01); *G10K 2210/3056* (2013.01)
USPC .... 381/71.8; 381/71.6; 381/71.11; 381/71.13

(58) Field of Classification Search
CPC ..... G10K 2210/3026; G10K 2210/3056; G10K 11/178
USPC ..... 381/71.1–71.14, 71.6, 71.11, 71.13
See application file for complete search history.

(56) References Cited

U.S. PATENT DOCUMENTS 5,175,698 A 12/1992 Barbanell
6,118,878 A 9/2000 Jones
(Continued)

FOREIGN PATENT DOCUMENTS

EP 0195641 A2 9/1986
GB 2149614 A 6/1985
(Continued)

OTHER PUBLICATIONS

Jin et al: "A Simultaneous Equation Method-Based Online Secondary Path Modeling Algorithm for Active Noise Control"; Journal of Sound and Vibration, 2007, vol. 303, pp. 455-474.
(Continued)

*Primary Examiner* — Davetta W Goins
*Assistant Examiner* — Oyesola C Ojo

(57) ABSTRACT

A noise canceling system comprises a microphone generating a captured signal and a sound transducer radiating a sound canceling audio signal in the audio environment. A feedback path from the microphone to the sound transducer includes a non-adaptive canceling filter and a variable gain and receives the captured signal and generates a drive signal for the sound transducer. A gain detector determines a secondary path gain for at least part of a secondary path of a feedback loop. The secondary path may include the microphone, the sound transducer, and the acoustic path therebetween but does not include the non-adaptive canceling filter or the variable gain. A gain controller adjusts the in of the variable gain in response to the secondary path gain. The system use simple gain estimation and control to efficiently compensate for variations in the secondary path to provide improved stability and noise canceling performance.

13 Claims, 7 Drawing Sheets

(56) References Cited

U.S. PATENT DOCUMENTS

| | | | | |
|---|---|---|---|---|
| 6,278,786 | B1 * | 8/2001 | McIntosh | 381/71.6 |
| 6,594,365 | B1 * | 7/2003 | Eatwell | 381/73.1 |
| 7,885,417 | B2 * | 2/2011 | Christoph | 381/71.11 |
| 8,422,691 | B2 * | 4/2013 | Asada et al. | 381/71.1 |

FOREIGN PATENT DOCUMENTS

| | | | | |
|---|---|---|---|---|
| JP | 0511777 | | 1/1993 | |
| JP | 06265468 | | 10/1993 | |
| JP | 6012088 | A | 1/1994 | |
| JP | 8510565 | | 5/1996 | |
| JP | 2007110535 | | 4/2007 | |
| JP | 2007240704 | A | 9/2007 | |
| WO | WO 99/31956 | * | 12/1998 | G11B 7/09 |
| WO | 9905998 | A1 | 2/1999 | |
| WO | WO-9931956 | * | 7/1999 | G11B 7/09 |

OTHER PUBLICATIONS

Akhtar, M.:"A New Method for Active Noise Control Systems With Online Acoustic-Feedback-path Modeling"; 2006 IEEE International Conference on Engineering of Intelligent Systems (IEEE Cat. No. 06EX1417), 6 Page Document.

Akhtar et al:"On Active Noise Control Systems With Online Acoustic Feedback Path Modeling"; IEEE Transactions on Audio, Speech, and Language Processing, Feb. 2007, vol. 15, No. 2, pp. 593-600.

Laroche, J.: "Optimal Constraint-Based Loop-Shaping in the Cepstral Domain"; IEEE Signal Processing Letters, Apr. 2007. vol. 14, No. 4, pp. 225-227.

* cited by examiner

100

ACTIVE AUDIO NOISE CANCELLING

FIELD OF THE INVENTION

The invention relates to an audio noise canceling system and in particular, but not exclusively, to an active audio noise canceling system for headphones.

BACKGROUND OF THE INVENTION

Active noise canceling is becoming increasingly popular in many audio environments wherein undesired sound is perceived by users. For example, headphones comprising active noise canceling functionality have become popular and are frequently used in many audio environments such as on noisy factory floors, in airplanes, and by people operating noisy equipment.

Active noise canceling headphones and similar systems are based on a microphone sensing the audio environment typically close to the users ear (e.g. within the acoustic volume created by the earphones around the ear). A noise cancellation signal is then radiated into the audio environment in order to reduce the resulting sound level. Specifically, the noise cancellation signal seeks to provide a signal with an opposite phase of the sound wave arriving at the microphone thereby resulting in a destructive interference that at least partly cancels out the noise in the audio environment. Typically, the active noise canceling system implements a feedback loop which generates the sound canceling signal based on the audio signal measured by the microphone in the presence of both the noise and the noise cancellation signal.

The performance of such noise cancellation loops is controlled by a canceling filter implemented as part of the feedback loop. The canceling filter is sought to be designed such that the optimum noise canceling effect can be achieved. Various algorithms and approaches for designing a canceling filter are known. For example, an approach for designing the canceling filter based on the Cepstral domain is described in J. Laroche. "Optimal Constraint-Based Loop-Shaping in the Cepstral Domain", IEEE Signal process. letters, 14(4):225 to 227, April 2007.

However, as the feedback loop essentially represents an Infinite Impulse Response (IIR) filter, the design of the canceling filter is constrained by the requirement for the feedback loop to be stable. The stability of the overall closed loop filter is guaranteed by using Nyquist' stability theorem which requires that the overall closed loop transfer function does not encircle the point $z=-1$ in the complex plane for $z=\exp(j\theta)$ with $0\leq\theta<2\pi$.

However, whereas the canceling filter tends to be a fixed, non-adaptive filter in order to reduce complexity and simplify the design process, the transfer functions of parts of the feedback loop tend to vary substantially. Specifically, the feedback loop comprises a secondary path which represents other elements of the loop than the canceling filter including the response of the analog to digital and digital to analog converters, anti-aliasing filters, power amplifier, loudspeaker, microphone and the transfer function of the acoustic path from the loudspeaker to the error microphone. The transfer function of the secondary path varies substantially as a function of the current configuration of the headphones. For example, the transfer function of the secondary path may change substantially depending on whether the headphones are in a normal operational configuration (i.e. worn by a user), are not worn by a user, are pressed towards the head of a user etc.

Since the feedback loop has to be stable in all scenarios, the canceling filter is restricted by having to ensure stability for all different possible transfer functions of the secondary path. Therefore, the design of the canceling filter tends to be based on a worst case assumption for the transfer function of the secondary path. However, although such an approach may ensure stability of the system, it tends to result in reduced performance as the ideal noise canceling function for the specific current secondary path transfer function is not implemented by the canceling filter.

Hence, an improved noise canceling system would be advantageous and in particular a noise canceling system allowing increased flexibility, improved noise cancellation, reduced complexity, improved stability performance and characteristics, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a noise canceling system comprising: a microphone for generating a captured signal representing sound in an audio environment; a sound transducer for radiating a sound canceling audio signal in the audio environment; a feedback means from the microphone to the sound transducer, the feedback means receiving the captured signal and generating a drive signal for the sound transducer and comprising a non-adaptive canceling filter and a variable gain; gain determining means for determining a secondary path gain for at least part of a secondary path of a feedback loop, the feedback loop comprising the microphone, the sound transducer and the feedback means with the secondary path not including the non-adaptive canceling filter and the variable gain; and gain setting means for adjusting a gain of the variable gain in response to the secondary path gain.

The invention may provide improved performance for a noise canceling system. Complexity may be kept low while still allowing a flexible adaptation to different operational configurations. Specifically, the inventor has realized that variations in the secondary path, and in particularly in the transfer function for the acoustic section from the sound transducer to the microphone, can advantageously be compensated by adjusting only a gain of the feedback means. In particular, the frequency and phase response of the transfer function of the canceling filter may be maintained constant while still achieving an improved noise cancellation. Furthermore, the inventor has realized that a low complexity gain determination for the secondary path followed by an adjustment of the gain of the feedback loop may be sufficient to improve the noise canceling performance for variations in the secondary path. Also, the inventor has realized that by measuring a secondary path gain and adjusting the gain of the feedback means accordingly, the stability constraints for the canceling filter can be reduced thereby allowing implementation of a more optimal canceling filter.

The noise canceling system is arranged to adjust the gain of the feedback means but no other modifications to the transfer function of the feedback means in response to a measured characteristic of the secondary path is made.

The transfer function of the secondary path may correspond to the transfer function of all other elements of the feedback loop than the canceling filter and the variable gain and may specifically include the acoustic path from the sound transducer to the microphone.

In accordance with an optional feature of the invention, the gain determining means comprises: means for injecting a test signal in the feedback loop; means for determining a first signal level corresponding to the test signal at an input of the at least part of the secondary path; means for determining a second signal level corresponding to the test signal at an output of the at least part of the secondary path; and means for determining the secondary path gain in response to the first signal level and the second signal level.

This may provide an efficient and high performance noise canceling system. The test signal may be injected at the input of the at least part of the secondary path by a summation (or other combination) of the feedback loop signal and the test signal. The first signal level may be determined by a measurement of the combined signal (of the test signal and the feedback loop signal) at the input to the at least part of the secondary path e.g. combined with a correlation with the test signal characteristics (e.g. bandpass filtering). In some embodiments, the first signal level may be determined as the signal level of the test signal. For example, if the signal level of the test signal substantially exceeds the feedback loop signal, the signal level at the input of the at least part of the secondary path (e.g. at the output of the summation unit/combiner used to inject the signal) may be determined as the signal level of the test signal being input to the summation unit/combiner.

The second signal level may be determined by directly measuring the signal level at the output of the at least part of the secondary path (combined with a correlation with the test signal characteristics e.g. in the form of a bandpass filtering) or may e.g. be determined by measuring another signal in the feedback loop and determining the signal level at the output of the at least part of the secondary path therefrom.

The secondary path gain may specifically be determined in response to the ratio between the second signal level and the first signal level.

In accordance with an optional feature of the invention, the output of the at least part of the secondary path corresponds to at least one of an input of the variable gain 117 and an input of the non-adaptive canceling filter.

This may improve performance. In particular, it may provide an improved characterization of the feedback loop and may e.g. allow the impact of all elements of the secondary path to be taken into account. Specifically, it may correspond to gain determination for the complete secondary path.

In accordance with an optional feature of the invention, the means for determining the first signal level is arranged to determine the first signal level in response to a signal level of the test signal and without measuring a signal of the feedback loop.

This may allow reduced complexity and/or simplified operation while maintaining accurate determination of the secondary path gain in many embodiments. The approach may be particularly suitable for embodiments where the signal level of the test signal is set substantially higher than the feedback loop signal at the point where the test signal is injected.

In accordance with an optional feature of the invention, the test signal is a narrowband signal having a 3 dB bandwidth of less than 10 Hz.

The inventor has realized that typical variations of the secondary path gain in many embodiments is such that the gain variation at different frequencies is sufficiently low to allow an advantageous compensation for variations in the secondary path to be based on a gain measurement performed in a very narrow frequency band. The use of a narrowband signal may reduce the perceptibility of the signal to a user and may reduce the impact of the test signal on the feedback loop behavior and the noise canceling efficiency. It may furthermore facilitate or allow the test signal to be located at a frequency where it is less likely to be perceived by a user (e.g. outside the normal human hearing frequency range).

In accordance with an optional feature of the invention, the test signal is substantially a sinusoid.

This may provide particularly advantageous performance and/or may facilitate operation and/or reduce complexity.

In accordance with an optional feature of the invention, the test signal has a central frequency within an interval from 10 Hz to 40 Hz.

This may allow a particularly advantageous test performance and may in particular provide an improved trade-off between the signal being noticeable to a user and being suitable for accurate measurements. In particular, it may allow the sound transducer to reproduce the test signal while at the same time allowing this to not be perceived (or to be perceived at a low level) by a user.

In accordance with an optional feature of the invention, the test signal is a noise signal.

This may allow improved performance and/or facilitated implementation and/or operation in many embodiments.

In accordance with an optional feature of the invention, the noise canceling system of further comprises means for measuring a third signal level for a signal corresponding to the input of the at least part of the secondary path in the absence of the test signal; and means for setting a signal level of the test signal in response to the third signal level.

This may allow an improved determination of the secondary path gain and thus an improved noise cancellation and/or stability characteristics. For example, the signal level of the test signal may be set to ensure that the second signal level (e.g. within the bandwidth of the test signal) is dominated by the test signal.

In accordance with an optional feature of the invention, an attenuation of a signal component corresponding to the test signal by the non-adaptive canceling filter is at least 6 dB.

This may allow facilitated implementation and/or operation and/or improved accuracy in the determination of the secondary path gain and thus improved noise canceling. For example, it may allow the impact of the feedback on the test signal to be reduced to a level where it can be ignored thereby facilitating the measurement of the secondary path gain.

In accordance with an optional feature of the invention, the noise canceling system further comprises means for feeding a user audio signal to the sound transducer, and the gain determining means comprises: means for determining a first signal level corresponding to the user audio signal at an input of the at least part of the secondary path; means for determining a second signal level corresponding to the user audio signal at an output of the at least part of the secondary path; and means for determining the secondary path gain in response to the first signal level and the second signal level.

This may allow improved performance and/or facilitated implementation and/or operation in many embodiments.

In accordance with an optional feature of the invention, the gain setting means is arranged to set the gain of the variable gain such that a combined gain of the secondary path gain and the gain of the variable gain has a predetermined value.

This may provide particularly advantageous compensation for variations in the secondary path in many embodiments.

In accordance with an optional feature of the invention, the secondary path comprises a digital section and the at least part of the secondary path comprises at least one of an analog to digital converter and a digital to analog converter.

The noise canceling system may be implemented using digital techniques and the compensation is suitable for e.g. partly digital feedback loops.

According to an aspect of the invention there is provided a method of operation for a noise canceling system including: a microphone for generating a captured signal representing sound in an audio environment; a sound transducer for radiating a sound canceling audio signal in the audio environment; a feedback means from the microphone to the sound transducer, the feedback means receiving the captured signal and generating a drive signal for the sound transducer and comprising a non-adaptive canceling filter and a variable gain; the method comprising: determining a secondary path gain for at least part of a secondary path of a feedback loop, the feedback loop comprising the microphone, the sound transducer and the feedback means with the secondary path not including the non-adaptive canceling filter and the variable gain; and adjusting a gain of the variable gain in response to the secondary path gain.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to an audio noise canceling system for a headphone. However, it will be appreciated that the invention is not limited to this application but may be applied to many other applications including for example noise canceling for vehicles.

Figure 1:
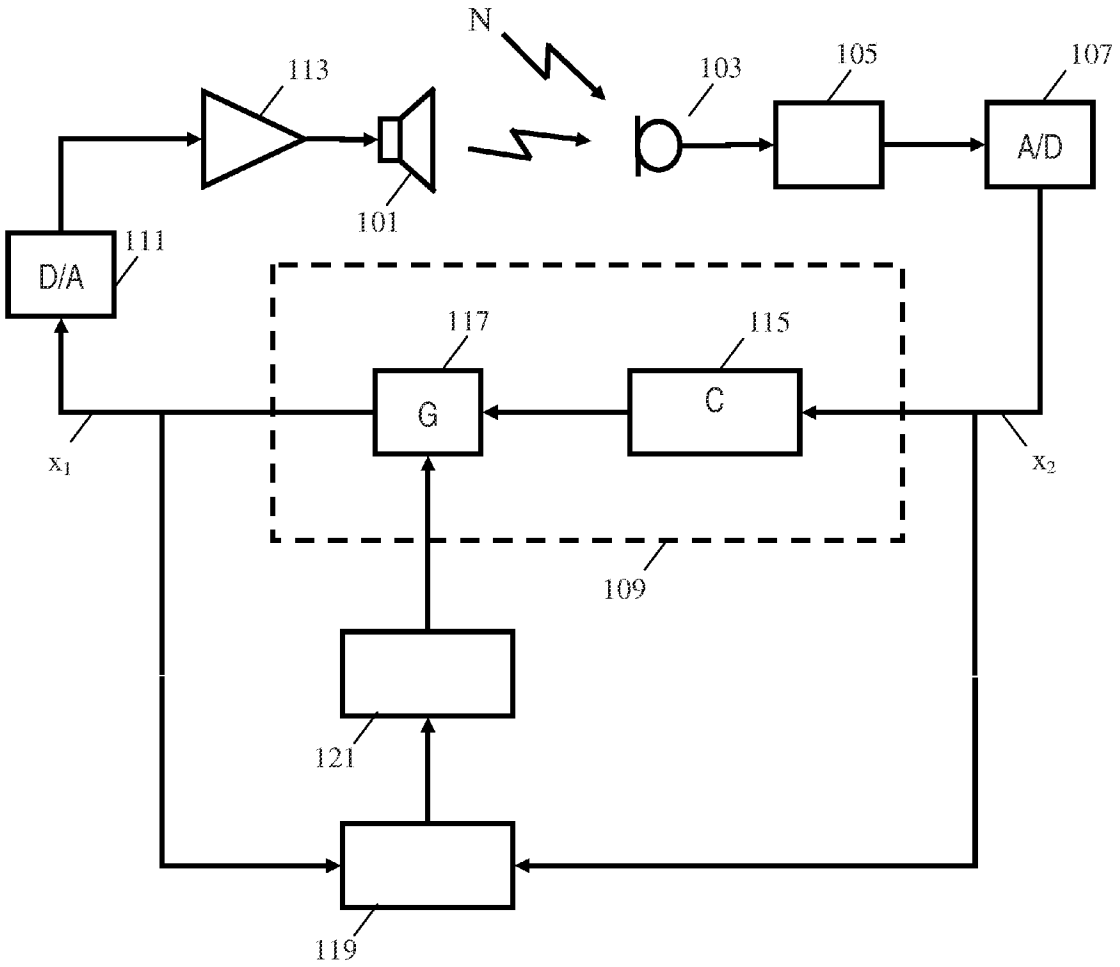
FIG. 1 illustrates an example of a noise canceling system in accordance with some embodiments of the invention.

FIG. 1 illustrates an example of a noise canceling system in accordance with some embodiments of the invention. In the specific example, the noise canceling system is a noise canceling system for a headphone. It will be appreciated that FIG. 1 illustrates the exemplary functionality for one ear and that identical functionality may be implemented for the other ear.

The noise canceling system comprises a sound transducer which in the specific example is a speaker 101 of the headphone. The system furthermore comprises a microphone 103 which is located close to the user's ear. In the specific example, the headphone may be a circumaural headphone which encloses the user's ear and with the microphone mounted to capture the audio signal within the acoustic space formed around the user's ear by the circumaural headphone.

Figure 2:
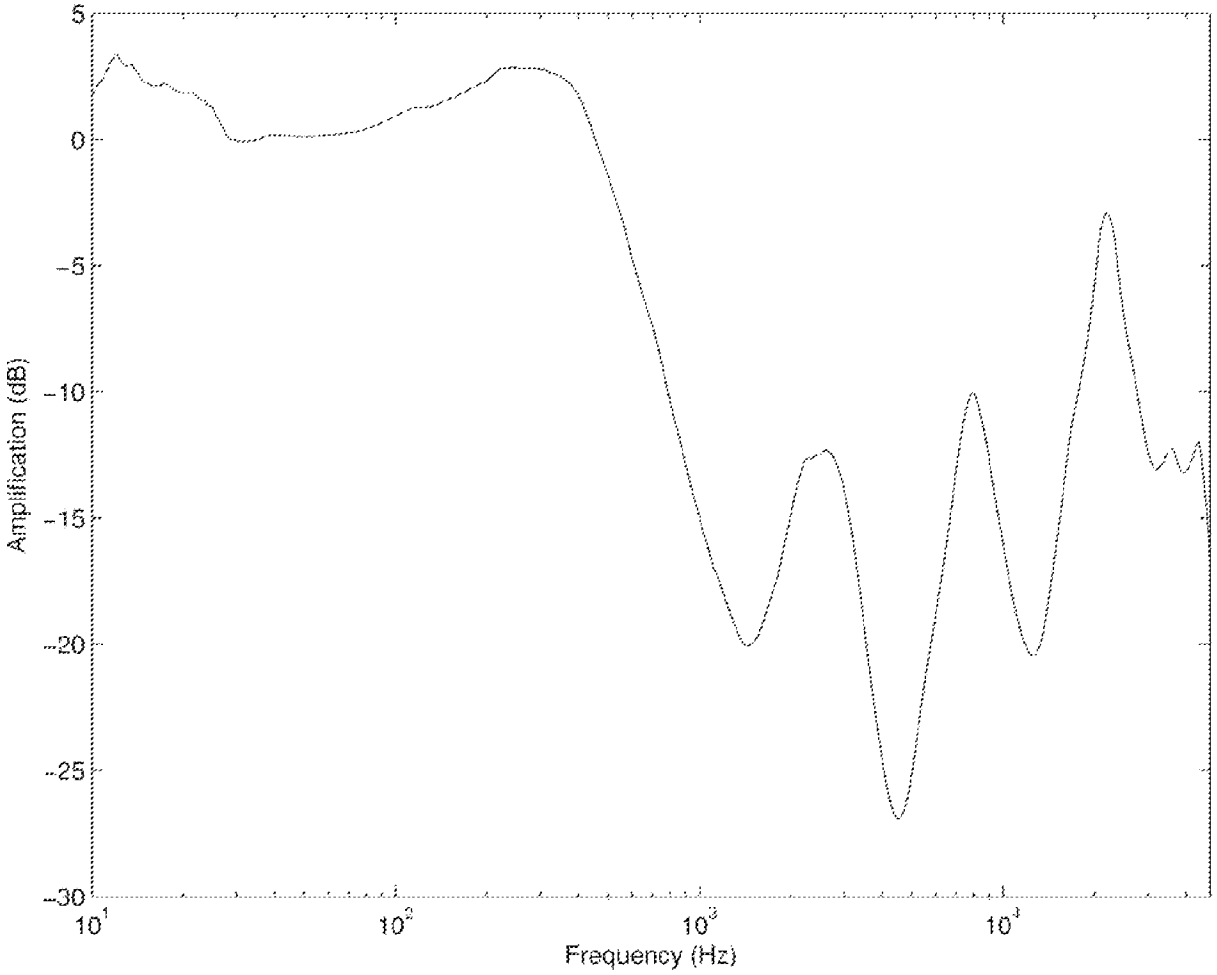
FIG. 2 illustrates an example of a passive transfer function for a set of closed headphones.

The goal of the noise canceling system is to attenuate or cancel sound perceived by the user and thus the system seeks to minimize the error signal e measured by the microphone 103. The use of a closed headphone may furthermore provide passive noise attenuation which tends to be particularly effective at higher frequencies. An example of a typical passive transfer function for a set of closed headphones is shown in FIG. 2. Furthermore the active noise cancellation system of FIG. 1 is particularly suitable for canceling noise at lower frequencies. This is achieved by generating an anti-phase signal for the audio signal and feeding this to the speaker 101 for radiation into the acoustic environment perceived by the user. Thus, the microphone 103 captures an error signal which corresponds to the acoustic combination of the audio noise N that is to be cancelled and the noise cancellation signal provided by the speaker 101.

In order to generate the noise cancellation signal, the system of FIG. 1 comprises a feedback path from the output of the microphone 103 to the input of the speaker 101 thereby creating a closed feedback loop.

In the example of FIG. 1, the feedback loop is implemented mostly in the digital domain and accordingly the microphone 103 is coupled to an anti-aliasing filter 105 (typically including a low noise amplifier) which is further coupled to an Analog to Digital (A/D) converter 107.

The digitized signal is fed to a digital feedback path 109 which is further coupled to a Digital to Analog (D/A) converter 111. The resulting analog signal is fed to a drive circuit 113 (typically including a power amplifier) which is coupled to the speaker 101 and which drives the speaker 101 to radiate the noise cancellation signal.

In the system, a feedback loop is thus created which includes a feedback path 109 and a secondary path which comprises the elements that are not part of the feedback path 109. The secondary path thus has a transfer function corresponding to the combined transfer function of the components of the feedback loop excluding the feedback path 109. Hence, the transfer function of the secondary path corresponds to the transfer function of the (open loop) path from the output of the feedback path 109 to the input of the feedback path 109. In the specific example, the secondary path comprises the D/A converter 111, the drive circuit 113, the speaker 101, the acoustic path from the speaker 101 to the microphone 103, the anti-aliasing filter 105 and the A/D converter 107.

The noise canceling system of FIG. 1 furthermore comprises functionality for dynamically adapting the feedback loop in response to variations in a transfer function for at least part of the secondary path. However, the adaptation of the feedback loop is limited to an adaptation of the feedback gain and there is no adaptation of any frequency response (whether phase or amplitude response). Thus, in the specific example, the feedback path 109 comprises a canceling filter 115 and a variable gain 117.

It will be appreciated in other some embodiments the variable gain 117 and the canceling filter 115 may be implemented together, for example by the variable gain being achieved by varying the filter coefficients of a filter providing the canceling filter (so as to modify the gain but not the frequency response, e.g. all coefficients are scaled identically). It will furthermore be appreciated that in some embodiments the variable gain 117 and the canceling filter 115 may be implemented as separate functional elements and may be located differently in the feedback loop. For example, the variable gain 117 may be located before the canceling filter 115 or e.g. in the analog domain (e.g. it may be implemented as part of the drive circuit 113).

Figure 3:
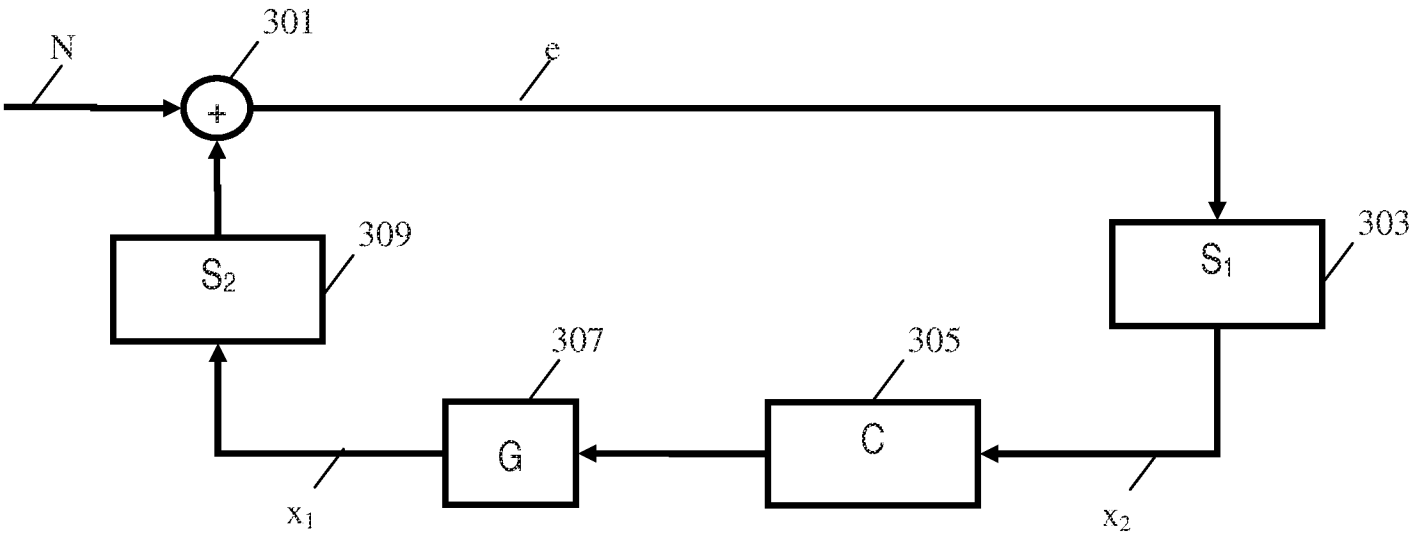
FIG. 3 illustrates an example of an analytical model for a noise canceling system in accordance with some embodiments of the invention.

FIG. 3 illustrates an analytical model of the system of FIG. 1. In the model, the audio summation performed by the microphone 103 is represented by a summer 301, the path from the microphone to the canceling filter 115 is represented by a first secondary path filter ($s_1$) 303, the canceling filter 115 is represented by a corresponding filter response 305, the variable gain 117 by a gain function 307 and the part of the secondary path from the variable gain 117 to the microphone 103 by a second secondary path filter ($s_2$) 309.

Figure 4:
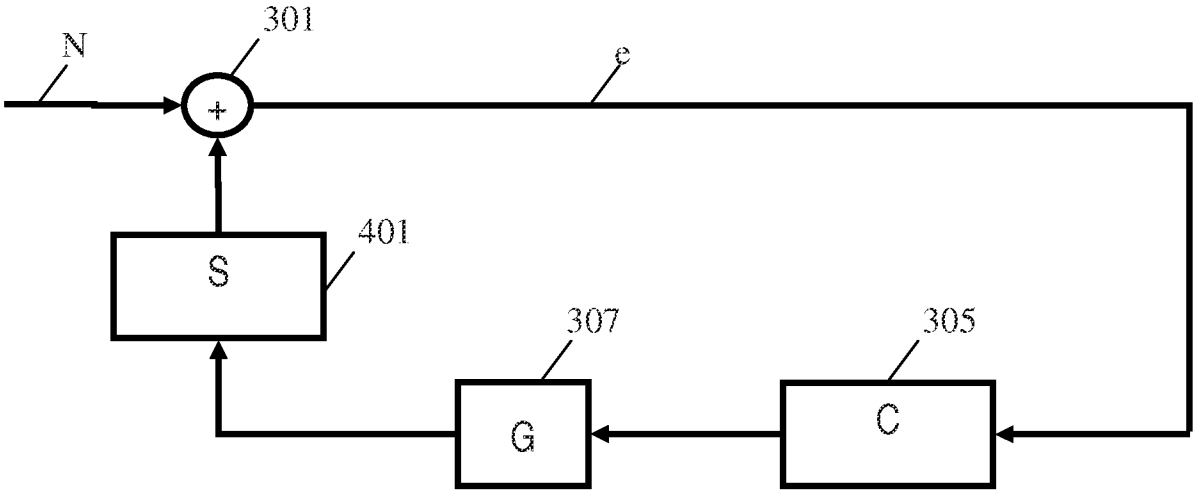
FIG. 4 illustrates an example of an analytical model for a noise canceling system in accordance with some embodiments of the invention.

In the model, the order of the elements of the feedback path may be interchanged and thus the first secondary path filter ($s_1$) 303 and the second secondary path filter ($s_2$) 309 may be combined into a single secondary path filter ($s=s_1 \cdot s_2$) 401 as shown in FIG. 4.

The closed loop transfer function E(f)/N(f) for the noise signal N can accordingly be determined as:

$$H(f)\frac{E(f)}{N(f)} = \frac{1}{1 - G \cdot C(f) \cdot s_1(f) \cdot s_2(f)} = \frac{1}{1 - G \cdot C(f) \cdot s(f)}$$

or in the digital z-transform domain:

$$H(z)\frac{E(z)}{N(z)} = \frac{1}{1 - G \cdot C(z) \cdot s_1(z) \cdot s_2(z)} = \frac{1}{1 - G \cdot C(z) \cdot s(z)}$$

The aim of the noise canceling system is to provide an overall transfer function H(f) (or H(z)) which attenuates the incoming signal as much as possible (i.e. resulting in the signal e captured by the microphone 103 being as low as possible).

The inventor of the current invention has realized that a highly efficient adaptation of the feedback loop to compensate for variations in transfer functions of the secondary path, and in particularly in the acoustic path from the speaker 101 to the microphone 103, can be achieved without having to perform complex adaptation of the canceling filter 115 and specifically without requiring any adaptation of the frequency response of this. Thus, a non-adaptable canceling filter 115 is used. Instead of a complex frequency response adaptation of the canceling filter, a low complexity gain variation can be used to provide improved performance while maintaining low complexity.

The system of FIG. 1 comprises a gain detector 119 which is arranged to determine a gain for at least part of the secondary path of the feedback loop. In the specific example, such a secondary path gain is determined for the transfer function from the output of the feedback path 109 to the input of the feedback path 109 which in the specific example corresponds to a secondary path gain from the input of the D/A converter 111 to the output of the A/D converter 107. Thus, in the specific example, the gain detector 119 is coupled to the output of the A/D converter 107 and the input of the D/A converter 111.

In the example, a gain is thus determined for the entire secondary path but it will be appreciated that in other embodiments, the gain may be determined for only part of the secondary path. For example, elements that are unlikely to affect the gain or to affect it only statically may be excluded from the determination and may accordingly be ignored or compensated for. In most typical systems, the transfer function variations for the secondary path will be dominated by variations in the acoustic path from the speaker 101 to the microphone 103 and the determined secondary path gain will accordingly in many embodiments advantageously be determined for a part of the second path that includes this acoustic path.

In the specific example, the gain detector 119 may determine the gain by measuring a first signal level $x_1$ at the output of the feedback path 109 and a second signal level $x_2$ at the input to the feedback path 109. The secondary path gain may then be determined as the ratio between these, i.e.:

$$g_{SP} = \frac{x_2}{x_1}$$

It will be appreciated that such a determination may be impractical in many embodiments. In particular, the presence of noise N in the input signal to the microphone together with the feedback loop will result in the above ratio possibly not being an accurate reflection of the gain of the secondary path gain. Thus, this specific approach for determining a secondary path gain may in particular be used in scenarios wherein the noise signal N can be removed or compensated. For example, if the noise canceling system is used to cancel noise from a noise source that can be switched off (such as e.g. a machine that can be switched off temporarily) this may be done temporarily and instead a known noise signal may be injected in order to determine the secondary path gain for the current headphone configuration. As another example, a second microphone (e.g. outside the headphone) may be used to estimate the noise signal N and the estimate may be used to compensate the second signal level $x_2$ for the contribution from N.

However, in many examples, it is desired that the noise canceling is dynamically and continuously adapted to reflect dynamic variations in the secondary path and without requiring specific calibration operations (such as switching off the noise source).

Different approaches advantageous for determining a secondary path gain for such examples will be described later.

The gain detector 119 is furthermore coupled to a gain controller 121 which is further coupled to the variable gain 117. The gain controller 121 receives the determined secondary path gain and controls the gain of the variable gain 117 in dependence on the secondary path gain.

Specifically, the gain controller 121 may set the gain of the variable gain such that it compensates for a deviation of the secondary path gain from a nominal value. Specifically, the gain controller may set the variable gain such that a combined gain of the secondary path gain and the variable gain is substantially constant. E.g.:

$$g_{VG} = \frac{g_N}{g_{SP}}$$

where $g_{VG}$ is the gain of the variable gain 117, $g_N$ is the nominal gain, and $g_{SP}$ is the secondary path gain.

In other embodiments, the variable gain may be determined by a suitable mapping from the secondary path gain. The mapping may be represented by a look-up table or may e.g. be defined by a function of $x_1$ and $x_2$.

The advantageous approach of adapting merely a gain of the feedback loop without adapting a frequency response based on a single determined gain for (at least a part of) the secondary path is based on a realization by the inventor that the typical variations of the secondary path (and in particular the acoustic path) for different use configurations are sufficiently related to provide improved performance and stability characteristics without including detailed frequency characterization or adaptation.

Figure 5:
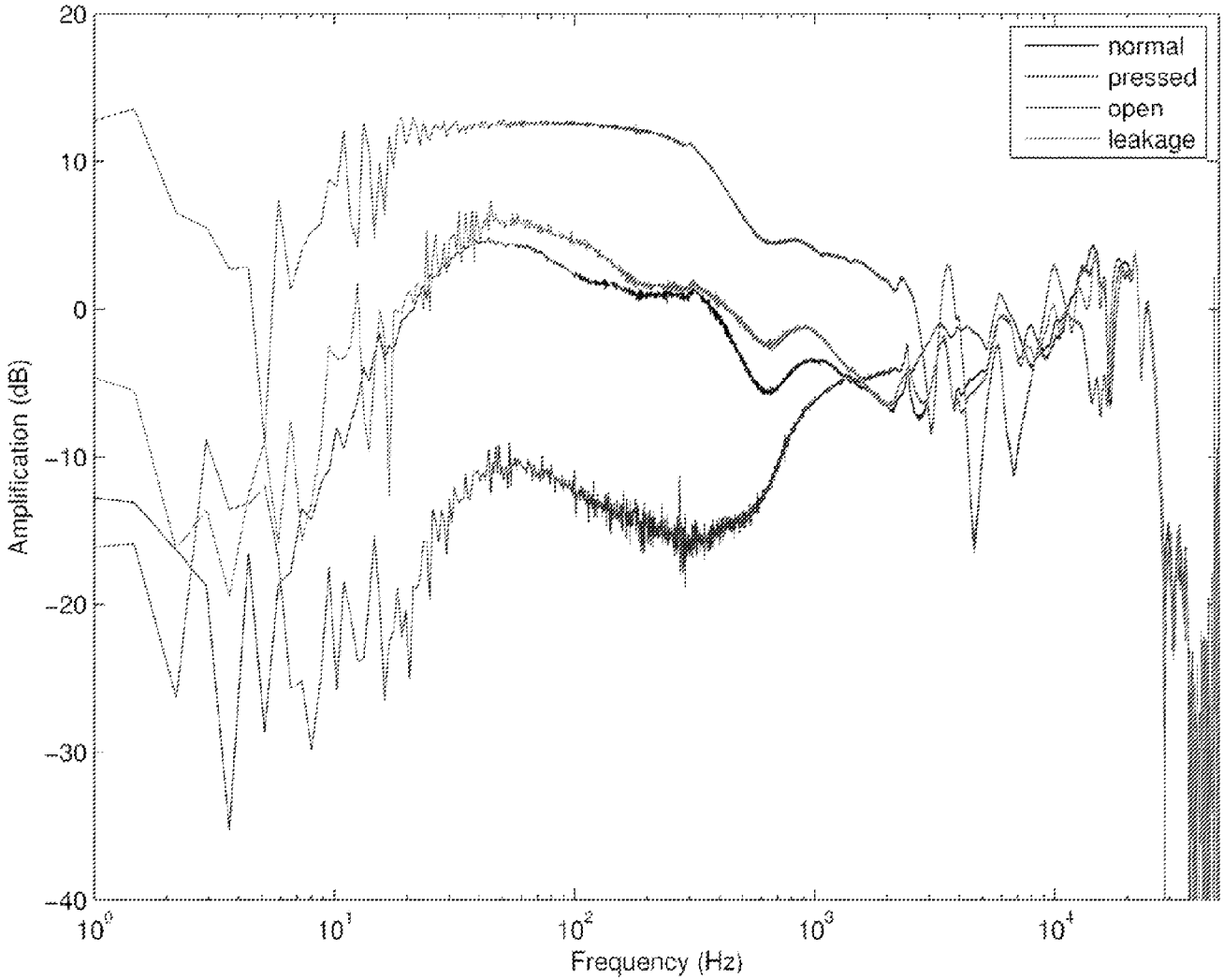
FIG. 5 illustrates examples of magnitude frequency responses measured for a secondary path of a noise canceling headphone for different configurations.

For example, FIG. 5 illustrates examples of variations in the magnitude frequency response measured for a secondary path of a noise canceling headphone for four different configurations:

Normal usage.

Headphones firmly pressed against the user's ears.

Headphones on the table (unused).

Slight leaks between the headphones and the user's head.

As can be seen there are large frequency variations in the magnitude response, especially up to around 2 kHz. Accordingly, the noise canceling performance may be highly dependent on the specific configuration and will tend to degrade in various configurations. Furthermore, stability must be ensured in all configurations and accordingly significant constraints are imposed on the design of the canceling filter 115.

Figure 6:
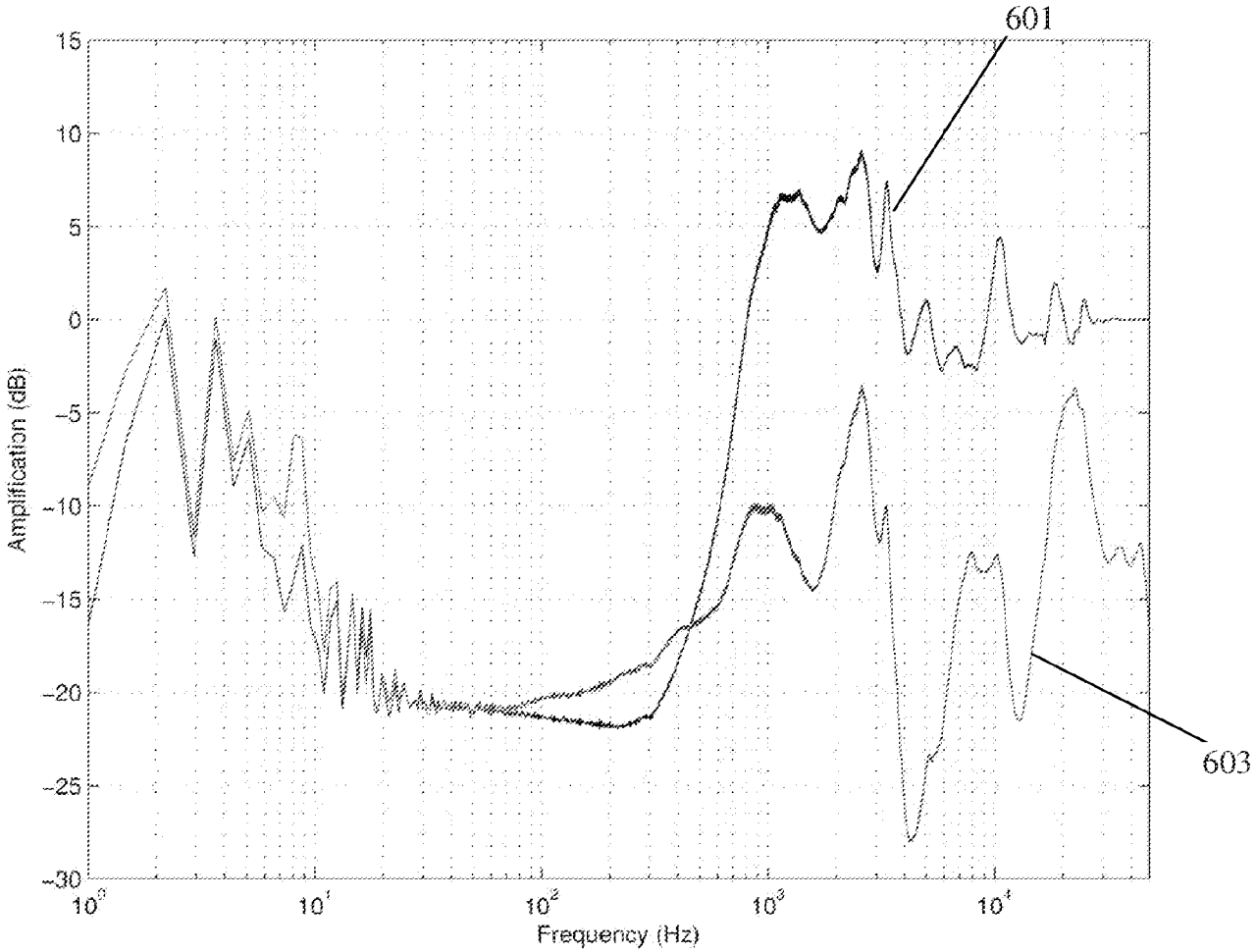
FIG. 6 illustrates an example of a magnitude transfer function for a noise canceling system in accordance with some embodiments of the invention.

For example, designing and implementing a canceling filter 115 which is suitable for all four secondary paths of the example of FIG. 5 may result in significant degradation in some configurations. For example, FIG. 6 illustrates the resulting magnitude transfer 601 function for H(f) for the situation where the headphones are firmly pressed against the user's head. The amplitude response 601 is combined with that of the passive transfer function of the headphone (corresponding to the curve 603 in FIG. 6). As can be seen, a substantial improvement is achieved for lower frequencies but at frequencies of around 800 Hz and above a substantial gain results thereby resulting in an amplification of the noise at these audible frequencies.

However, FIG. 5 indicates that the variations in the secondary path have a strong correlation and specifically that whereas the gain may vary, the shape of the curves are relatively similar. This effect is used in the system of FIG. 1 to provide a gain only based compensation of the feedback loop resulting in substantially improved noise canceling performance due to both the reduced operational variations in the overall transfer function H(f) as well as the increased freedom in optimizing the canceling filter 115.

Figure 7:
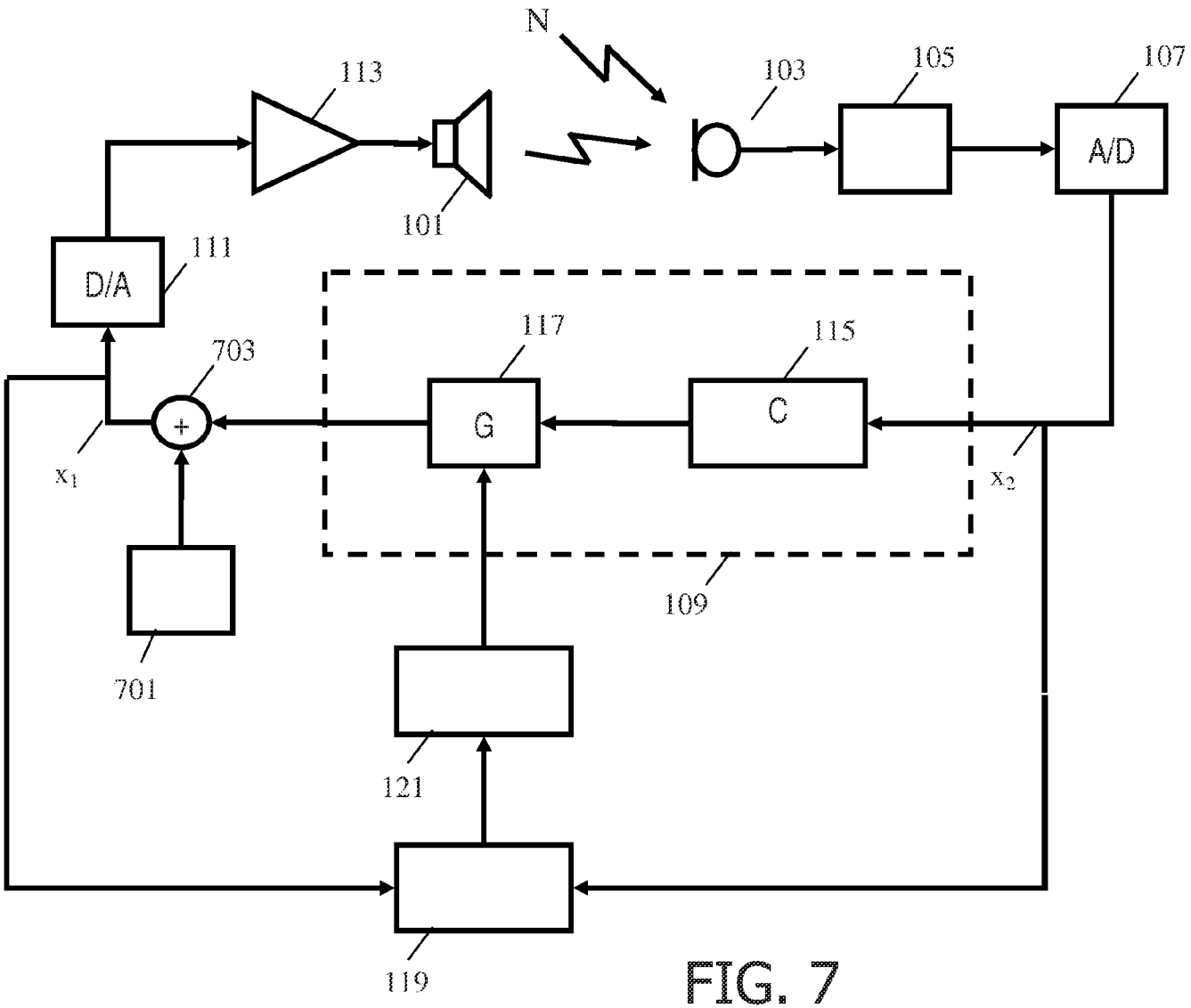
FIG. 7 illustrates an example of a noise canceling system in accordance with some embodiments of the invention.

FIG. 7 illustrates an example of the system of FIG. 1 wherein the secondary path gain is measured by injecting a test signal and measuring signal levels for the injected test signal. In the example, the system comprises a signal generator 701 which generates a test signal that is added to the feedback loop between the variable gain 117 and the D/A converter 111 by a combining unit which specifically is a summation unit 703.

Thus, the system injects a test signal and the gain detector 119 may be arranged to determine the signal level for this test signal at the output of the summation unit 703 $x_1$ and at the input to the canceling filter 115 $x_2$. The secondary path gain may then be generated as the ratio between these values. It will be appreciated that in other examples, signals at other locations in the feedback loop may be measured and used to determine the secondary path gain. For example, elements that have a constant gain may not be included in the measurements.

The gain detector 119 may in some embodiments simply measure the signal levels of the signals $x_1$ and $x_2$. For example, if the test signal is substantially larger than any contribution from the noise signal N, the directly measured signal levels may be considered to be substantially the same as the signal levels of the signal components relating to the test signal.

However, in other embodiments, the measurements may specifically aim at determining signal levels for the signal components that correspond to (originate from) the test signal. For example, the test signal may be a pseudo noise signal that is known to the gain detector 119. Accordingly, the gain detector may correlate the signals $x_1$ and $x_2$ with the known pseudo noise sequence and may use the correlation value as a signal level measure for the signal components of $x_1$ and $x_2$ that are due to the injected test signal.

The use of an injected signal may in many scenarios provide improved and simplified determination of the secondary path gain. For example, in scenarios wherein the noise source cannot be switched off or isolated from the acoustic path from the speaker 101 to the microphone 103, the injection of the signal may allow the secondary path gain to be accurately determined by injecting a test signal that is e.g. substantially stronger than the noise signal N.

The test signal may specifically be a narrowband signal. Indeed, the inventor has realized that an accurate adaptation of the noise canceling system can be achieved by simply adjusting a gain of the feedback loop based on a gain of the secondary path assessed in a narrow bandwidth. Thus, by injecting a test signal which has a narrow bandwidth the secondary path gain determined only for this small bandwidth is extended to provide a gain compensation which is constant for the entire frequency range.

The use of a narrow bandwidth test signal may be used to reduce the perceptibility of the test signal by the user. Indeed, the test signal may have a 3 dB bandwidth of no more than 10 Hz (i.e. the bandwidth defined by the spectral density of the signal being reduced by 3 dB is 10 Hz or less). In particular, advantageous performance may be achieved by using a single tone signal (a sinusoid) which may specifically facilitate detection and measurement of the signal level of the test signal component. Specifically, the gain detector 119 may simply perform a Discrete Fourier Transform on the measured signals $x_1$ and $x_2$ and the determine the signal level from the magnitude of the bin(s) corresponding to the frequency of the test signal. Alternatively (or equivalently) the gain detector 119 may correlate the measured signals with a sinusoid (corresponding to a sine or cosine signal) having the same frequency as the test signal (and specifically may correlate the measured signals directly with the digital test signal by aligning the timing/phase of the microphone signal with the test signal and measuring the correlation). As another example, complex values for a sinusoid at the test frequency (corresponding to the coefficients of the corresponding row of the DFT matrix) may be correlated with the microphone signal and the resulting magnitude may be determined. Furthermore, the use of a sinusoid may simplify the generation of the test signal.

Furthermore, the narrowband test signal is generated as a low frequency signal. Specifically, a central frequency of the test signal is selected to have a central frequency within the interval from 10 Hz to 40 Hz (both values included). This provides a highly advantageous trade-off as it allows a representative gain for the secondary path response up to typically at least 2 kHz to be determined based on a single narrowband signal. Furthermore, the low frequency is provided in a frequency range which is not easily perceived by a listener and thus any inconvenience to the user is avoided or reduced. Also, this is achieved while still allowing the test signal to be coupled across the acoustic path from the speaker 101 to the microphone 103. In other words, the frequency is sufficiently high that typical speakers for e.g. headphones can radiate the signal at reasonable signal levels.

In the specific example, a test signal consisting in a single tone between 15 Hz and 25 Hz is used (both values included) with a typical frequency being around 20 Hz. Thus, the approach exploits the realization that if the secondary path gain is known for one frequency lower than 2 kHz, the corresponding secondary path gain for frequencies up to about 2 kHz is known to a sufficient accuracy to allow improved performance by performing a simple gain adaptation. Thus, a sinusoid with a frequency at which the human ear is not sensitive (provided that the amplitude is not too large) is added in the feedback loop and the resulting signal levels are measured and used to estimate the secondary path gains.

It will be appreciated that if the noise signal N is not zero, the contribution of the noise signal N to the signal levels $x_1$ and $x_2$ will affect the determined secondary path gain. For a narrowband test signal, the measured signals $x_1$ and $x_2$ may be passband filtered (e.g. using a Discrete Fourier Transform or by correlating the signals with the test signal) by the gain detector 119 and the contribution of the signal components of the noise signal N within this passband may affect the determined secondary path gain.

However, the contribution may be reduced to acceptable or even negligible levels by ensuring that the test signal has significantly higher signal level within the given passband than the contribution from the noise signal N. For example, the signal level for the injected test signal may be set to a level which is much higher than the typical ambient noise level within the passband in which the test signal is measured. Furthermore, by using a narrowband signal, the contribution of the test signal over the ambient noise need only be dominant in a very small bandwidth which may furthermore be chosen to be outside the frequency range that is normally perceivable for a user.

In some embodiments, the signal level of the test signal may be dynamically adapted in dependence on a corresponding signal level for the ambient noise.

Specifically, the gain detector 119 may initially measure a signal level at the point where the test signal is injected but in the absence of the test signal. For example, the gain detector 119 may switch off the test signal generator 701 and proceed to measure the signal level for the signal component of $x_1$ that corresponds to the test signal, i.e. in the specific example it may proceed to measure the signal level within the narrow bandwidth used for measuring the test signal contribution to $x_1$. The signal level of the test signal may then be determined depending on this measured signal level. Specifically, the signal level may be set substantially higher, such as e.g. at least ten times higher, than the measured level in the absence of the test signal. This will ensure that the gain detector 119 predominantly determines the signal levels of the test signal components and that these components dominate the contribution from the ambient noise N in the specific bandwidth. Furthermore, as this bandwidth is outside the frequency range which is audible to a listener, the addition of a strong test signal does not (unacceptably) degrade the user experience.

In some embodiments, the ambient noise may be used to mask the test signal and the test signal level may be increased for better accuracy. For example, a frequency spectrum of the ambient noise may be determined and the masking effect corresponding to this spectrum may be used to set a characteristic of the test signal. For example, the signal level may be set to a level that is substantially higher than the ambient noise level at that frequency but which is still masked by e.g. a high level ambient noise component at a close frequency. In some embodiments, the frequency of the test signal may further be selected to fall within an area with low ambient noise but a high masking effect. Thus, a masking characteristic of the ambient noise may be determined a characteristic of the test signal may be set in response to this (e.g. signal level and/or frequency).

In the example of FIG. 7, the secondary path gain is determined by measuring the loop signals before and after the (part of the) secondary path for which the gain is to be determined. It will be appreciated that due to the effect of the feedback loop on the injected test signal, it is generally not sufficient to base the secondary path gain simply by a comparison of a single measured signal level in the feedback loop and the signal level of the injected test signal (i.e. the known signal level at the output of the test signal generator 701 being fed to the summation unit 703).

However, in some embodiments, the signal level for the signal $x_1$ may be determined from the signal level of the test signal rather than by a specific measurement of any loop signal. In particular, the test signal may be selected such that it is attenuated substantially by the canceling filter 115. The attenuation of the signal component of the input to the non-canceling filter 115 that arises from the presence of the test signal may specifically be 6 dB or higher (e.g. in some embodiments the signal may advantageously be attenuated by 10 dB or even 20 dB).

Thus, the system may be designed such that the test signal falls in the stop band of the canceling filter 115. For example, 90% or more of the test signal may be outside the passband of the canceling filter 115 wherein the passband is defined as the bandwidth in which the gain of the canceling filter 115 is within, say 7 dB, of the maximum gain of the canceling filter 115. Thus, the test signal component will be attenuated by around 6 dB by the canceling filter 115 (in many scenarios even higher values of e.g. 10-20 dB attenuation may be used). As a consequence, the contribution to $x_1$ (within the bandwidth of the test signal) is dominated by the contribution from the test signal generator 701 with the contribution from the feedback path 109 being low and in many scenarios negligible. In essence, the scenario corresponds to a system wherein the canceling filter 115 attenuates (or even blocks) the feedback signal for the test signal such that the system effectively corresponds to a non-feedback loop configuration for the test signal.

Thus, in such an embodiment the signal level of the signal $x_1$ within the relevant narrow bandwidth is (approximately) the same as the signal level of the test signal. Thus, in such embodiments, the gain detector 119 may directly use the signal level setting for the test signal when determining the secondary path gain.

In some systems, the loudspeaker 101 may also be used to provide a user audio signal to the user. For example, the user may listen to music using the headphones. In such systems, the user audio signal is combined with the feedback loop signal (e.g. at the input to the D/A converter 111) and the error signal from the microphone 103 is compensated by subtracting a contribution corresponding to the estimated user audio signal captured by the microphone 103. In such systems, the music signal may be used to determine the secondary path gain and specifically the signal values $x_1$ and $x_2$ may be measured and correlated to the user audio signal (with $x_2$ being measured prior to the compensation for the estimated user audio signal). Thus, in such examples the user audio signal may also be used as the test signal. In other words, in some examples, the test signal may be a user audio signal.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A noise canceling system comprising:

a microphone configured to generate a first analog signal representing a sound in an audio environment;

a sound transducer driven by an analog drive signal for radiating audio for canceling the sound in the audio environment;

an analog-to-digital (A/D) converter connected to the microphone for converting the first analog signal to a first digital signal;

a digital feedback circuit configured to connect between the microphone and the sound transducer, receive the first digital signal, and generate a digital drive signal for driving the sound transducer, the digital feedback circuit comprising a non-adaptive canceling filter and a variable gain, the microphone, the sound transducer and the digital feedback circuit forming a feedback loop;

a digital-to-analogy (D/A) converter connected to the sound transducer for converting the digital drive signal to the analog drive signal;

a gain detector connected in parallel with the digital feedback circuit between the A/D and D/A converters for determining a secondary gain for a secondary path of the feedback loop, the secondary path not including the non-adaptive canceling filter and the variable gain; and a gain setter for adjusting a gain of the variable gain in response to the secondary gain, wherein said noise cancelling system further comprises:

an adder coupled to a signal generator for injecting a test signal in the feedback loop, wherein the gain detector is configured to determine a first signal level corresponding to the test signal at an input of the secondary path, a second signal level corresponding to the test signal at an output of the secondary path, and the secondary gain in response to the first signal level and the second signal level.

2. The noise canceling system of claim 1, wherein the output of the secondary path corresponds to at least one of an input of the variable gain and an input of the non-adaptive canceling filter.

3. The noise canceling system of claim 1, wherein the gain detector is further configured to determine the first signal level in response to a signal level of the test signal and without measuring a signal of the feedback loop.

4. The noise canceling system of claim 1, wherein the test signal is a narrowband signal having a 3 dB bandwidth of less than 10 Hz.

5. The noise canceling system of claim 1, wherein the test signal is substantially a sinusoid.

6. The noise canceling system of claim 1, wherein the test signal has a central frequency within an interval from 10 Hz to 40 Hz.

7. The noise canceling system of claim 1, wherein the test signal is a noise signal.

8. The noise canceling system of claim 1, wherein the gain detector is further configured to measure a third signal level for a signal corresponding to the input of the secondary path in the absence of the test signal; and set a signal level of the test signal in response to the third signal level.

9. The noise canceling system of claim 1, wherein an attenuation of a signal component corresponding to the test signal by the non-adaptive canceling filter is at least 6 dB.

10. The noise canceling system of claim 1, wherein the sound transducer is configured to provide a user audio signal to a user, and the gain detector is configured to determine the first signal level corresponding to the user audio signal at an input of the secondary path, the second signal level corresponding to the user audio signal at an output of the secondary path; and the secondary gain in response to the first signal level and the second signal level.

11. The noise canceling system of claim 1, wherein the gain setter is configured to set the gain of the variable gain such that a combined gain of the secondary gain and the gain of the variable gain has a predetermined value.

12. The noise canceling system of claim 1, wherein the secondary path comprises an acoustic path from the sound transducer to the microphone.

13. A method of operation for a noise canceling system including:

driving a sound transducer by an analog drive signal to radiate audio for cancelling a sound in an audio environment;

receiving in a microphone a first analog signal representing the sound in the audio environment;

forming a feedback loop by providing a digital feedback circuit between the microphone and the sound transducer for receiving a first digital signal converted from the first analog signal and generating a digital drive signal for driving the sound transducer to radiate the audio, the digital feedback circuit comprising a non-adaptive cancelling filter and a variable gain;

determining a secondary gain for a secondary path of the feedback loop using a gain detector connected in parallel with the digital feedback circuit;

adjusting a gain of the variable gain in response to the secondary gain; and converting the digital drive signal to the analog drive signal, wherein the method further comprises:

generating a test signal using a signal generator; and injecting the test signal into the feedback loop, and wherein the secondary gain is determined by determining a first signal level corresponding to the test signal at an input of the secondary path, a second signal level corresponding to the test signal at an output of the secondary path, and the secondary gain in response to the first signal level and the second signal level.

* * * * *